United States Patent [19]

Mathieu

[11] 4,452,148

[45] Jun. 5, 1984

[54] CUSHIONED CENTER PLATE STRUCTURE FOR A RAILWAY VEHICLE BODY AND METHOD OF MAKING SAME

[75] Inventor: Julien C. Mathieu, Waynesville, N.C.

[73] Assignee: Dayco Corporation, Dayton, Ohio

[21] Appl. No.: 297,292

[22] Filed: Aug. 28, 1981

[51] Int. Cl.[3] ..... B61F 5/20

[52] U.S. Cl. ..... 105/199 C; 105/189; 384/422

[58] Field of Search ..... 105/189, 199 R, 199 C, 105/199 CB, 211, 185, 193; 280/86; 267/3; 384/422

[56] References Cited

U.S. PATENT DOCUMENTS

| | | | |
|---|---|---|---|
| 1,728,832 | 9/1929 | Kjolseth | 105/199 R X |
| 2,096,005 | 10/1937 | Piron | 105/199 R |
| 2,198,668 | 4/1940 | Janeway | 105/199 R |
| 2,499,087 | 2/1950 | Bourdun | 105/199 R |
| 3,359,923 | 12/1967 | Wood | 105/189 |
| 3,713,710 | 1/1973 | Wallace | 105/199 C X |
| 4,206,710 | 6/1980 | Spence | 105/199 C X |
| 4,341,162 | 7/1982 | Mathieu | 105/199 C |

FOREIGN PATENT DOCUMENTS

| | | | |
|---|---|---|---|
| 205067 | 9/1959 | Austria | 384/422 |

*Primary Examiner*—Randolph Reese
*Attorney, Agent, or Firm*—Joseph V. Tassone

[57] ABSTRACT

A cushioned center plate structure for a railway vehicle body and method of making same are provided wherein such structure comprises, a substantially cylindrical disc-like component which is adapted to be received within the confines of an upstanding peripheral flange of an associated railway vehicle truck bolster bowl, apparatus for mounting the component to a body bolster of the vehicle body, and apparatus for cushioning loads between the component and flange and wherein the mounting apparatus comprises a plate, fasteners for detachably fastening the plate to the body bolster, and structure for supporting the component on the plate.

10 Claims, 17 Drawing Figures

CUSHIONED CENTER PLATE STRUCTURE FOR A RAILWAY VEHICLE BODY AND METHOD OF MAKING SAME

BACKGROUND OF THE INVENTION

1. Field of the Invention

This invention relates to railway vehicles and more particularly to a cushioned center plate structure for a railway vehicle body and method of making such structure.

2. Prior Art Statement

Railway vehicles including locomotives, railway cars, and the like are each usually comprised of a main vehicle body which has body bolsters at opposite ends thereof and each body bolster has a body center plate structure which serves to transfer the load of the vehicle body at its associated end of the car to an associated truck which rides on railway tracks; and, each truck is provided with a truck bolster and a bolster bowl defined by a truck center plate structure which has an upstanding peripheral annular flange. Each railway vehicle body center plate structure is received within the confines of the flange of an associated bolster bowl and the entire load of the car body is transmitted through its body bolster center plate structures. During normal operation of the railway vehicle, the center plate structures and associated parts are subjected to high operating loads which include high vertical loads as well as high horizontal loads. The horizontal loads are exerted between each body center plate structure and an associated upstanding peripheral annular flange of a bolster bowl; and, it is desirable to provide cushioning means between each railway vehicle body center plate structure and its associated annular flange of an associated truck bolster bowl in an effort to eliminate or substantially reduce high horizontal impact loads between these components.

It is known in the art to provide a cushioned center plate structure for a railway vehicle body comprising a substantially cylindrical disc-like component which is adapted to be received within the confines of an upstanding peripheral flange of an associated railway vehicle truck bolster bowl, means for mounting the component to a body bolster of the vehicle body, and means for cushioning loads between the component and flange and as disclosed in U.S. Patent Application Ser. No. 179,192, filed Aug. 18, 1980, now U.S. Pat. No. 4,341,162 issued July 27, 1982 to the applicant herein. The cushioning means in this application serves to cushion horizontal loads between the above-mentioned component and flange. However, the above-mentioned known cushioned center plate structure has deficiencies of substantial complexity and comparative high cost.

It is an object of this invention to provide an improved cushioned center plate structure for a railway vehicle body.

Another object of this invention is to provide an improved method of making a cushioned center plate structure of the character mentioned.

Other aspects, embodiments, objects, and advantages of this invention will become apparent from the following specification, claims, and drawings.

SUMMARY

In accordance with the present invention, there is provided an improved cushioned center plate structure for a railway vehicle body which overcomes the above-mentioned deficiencies. The improved cushioned center plate structure comprises a substantially cylindrical disc-like component which is adapted to be received within the confines of an upstanding peripheral flange of an associated railway vehicle truck bolster bowl, means for mounting the component to a body bolster of the vehicle body, and means for cushioning loads between the component and the flange.

In accordance with one embodiment of this invention, the mounting means of the improved center plate structure comprises a plate, means for detachably fastening the plate to the body bolster, and means for supporting the component on the plate.

In accordance with another embodiment of this invention a cushioned center plate structure for a railway vehicle body is provided and comprises a substantially cylindrical disc-like component which is adapted to be received within the confines of an upstanding peripheral flange of an associated railway vehicle truck bolster bowl, means for mounting the component to a body bolster of the vehicle body, and means for cushioning loads between the component and flange and wherein the cushioning means comprises a plurality of resilient metal members fixed to the component and adapted to be disposed within the confines of the flange.

Also provided in accordance with this invention is an improved method of making a cushioned center plate structure for a railway vehicle body.

BRIEF DESCRIPTION OF THE DRAWINGS

The accompanying drawings show present preferred embodiments of this invention, in which.

DETAILED DESCRIPTION

Figure 1:
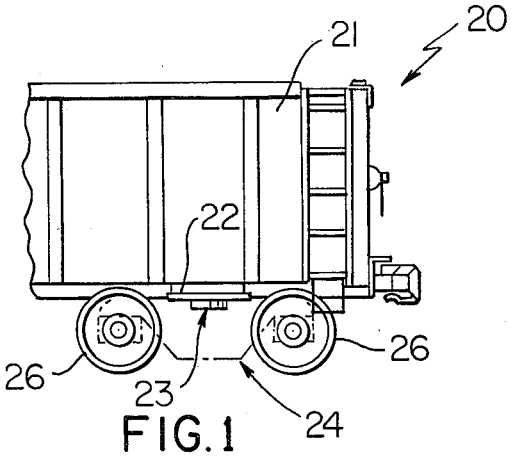
FIG. 1 is a fragmentary view in elevation of one end portion of an exemplary railway car and showing the wheels of the associated truck at the one end portion with the outline of the remainder of such truck being shown in dot-dash lines and particularly illustrating the location of an associated car body center plate structure.

Reference is now made to FIG. 1 of the drawings which illustrates an end portion of an exemplary railway vehicle in the form of a railway car which is designated generally by the reference numeral 20. The car 20 comprises a car body 21 having a pair of body bolsters 22 at opposite ends thereof with the body bolster 22 at only one end portion of the car 20 being illustrated. Each body bolster 22 has a cushioned body center plate structure made in accordance with this invention and such structure is designated generally by the reference numeral 23. As is known in the art, the entire load of the car body 21 is carried through its bolsters 22 and body center plate structures 23 to railway car trucks 24 at opposite ends of the car body 21.

Figure 2:
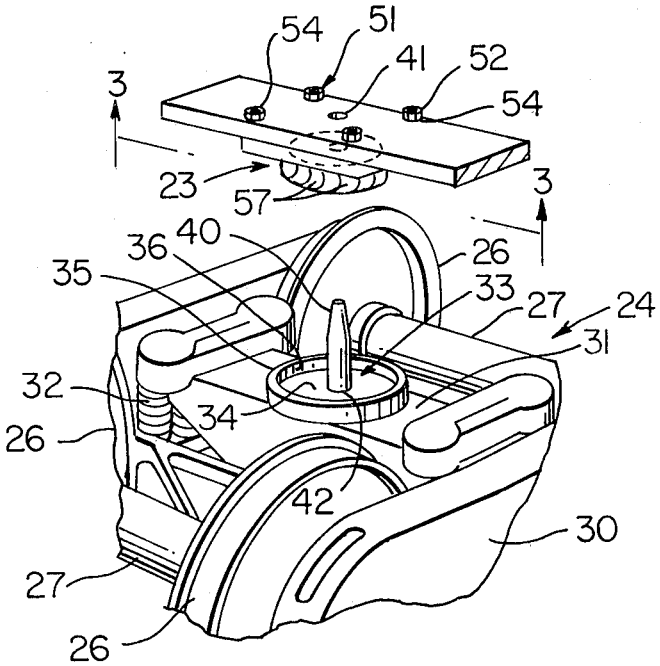
FIG. 2 is an isometric view with parts in cross-section, parts in elevation, and parts broken away particularly illustrating one exemplary embodiment of a cushioned center plate structure made in accordance with this invention mounted to an associated body bolster of the car body of FIG. 1 and an associated truck bolster with its bolster bowl defined by a truck center plate structure having an upstanding peripheral annular flange and a center pin associated with the center plate structures.

Only one truck 24 is shown in FIG. 1, with the major portion thereof being shown by dot-dash lines for simplicity and ease of presentation. A fragmentary portion of the truck 24 is illustrated in isometric view in FIG. 2 and it will be appreciated that the following description of the truck 24 is fully applicable to both trucks 24 of the railway car 20.

The truck 24 is comprised of four wheels 26, with a fragmentary portion of only three of such wheels being illustrated, and an axle 27 extending between each associated pair of wheels 26. The truck 24 has a structural frame assembly 30 carried by the axles 27 and such axles are freely rotatable while carrying the frame assembly 30. The frame assembly 30 carries a truck bolster 31, as is known in the art, employing resilient mounting means shown as compression spring sets 32 at opposite sides of the truck 24.

The truck bolster 31 comprises a bolster bowl which is designated by the reference numeral 33, and the bowl 33 is defined by a truck center plate 34 which has an upstanding peripheral annular flange 35. During normal operation of the railway vehicle or car 20, an associated body center plate structure 23 is received concentrically within the confines of the flange 35 and is supported by the truck center plate 34 and flange 35.

The truck center plate 34 has a substantially planar and horizontally disposed top supporting surface and the peripheral annular flange 35 has a right circular cylindrical inside surface 36. Once a body center plate structure 23 is received within a bolster bowl 33 of an associated truck bolster 31, the entire load at the associated end of the railway car body, both horizontal and vertical load, is carried by the body center plate structure 23 and the truck center plate 34 with its peripheral annular flange 35.

The railway car 20 has the usual center pin or king bolt 40 associated with each truck 24. The upper portion of each pin 40 extends through a right circular cylindrical bore 41 which extends through its body center plate structure 23 and continues into its body bolster 22. The lower portion of each pin 40 extends into its truck center plate 34 and continues into its truck bolster 31 through a blind bore 42. As is known in the art, the center pin serves as a safety pin and is not used in carrying or transmitting loads between the body center plate structure 23 and the bolster bowl 33.

Each truck 24 turns about its associated center pin 40 and there are substantial clearances between each pin 40 and its associated bores 41 and 42 to allow unobstructed turning. In addition, the clearances are such that a cup-shaped center plate liner of any suitable type known art may be disposed between each bolster bowl 33 and an associated body center plate 23. Similarly, a simple disc-like liner of known construction may be disposed between the bottom planar surface of the structure 23 and the top planar surface of the center plate 34.

Figure 3:
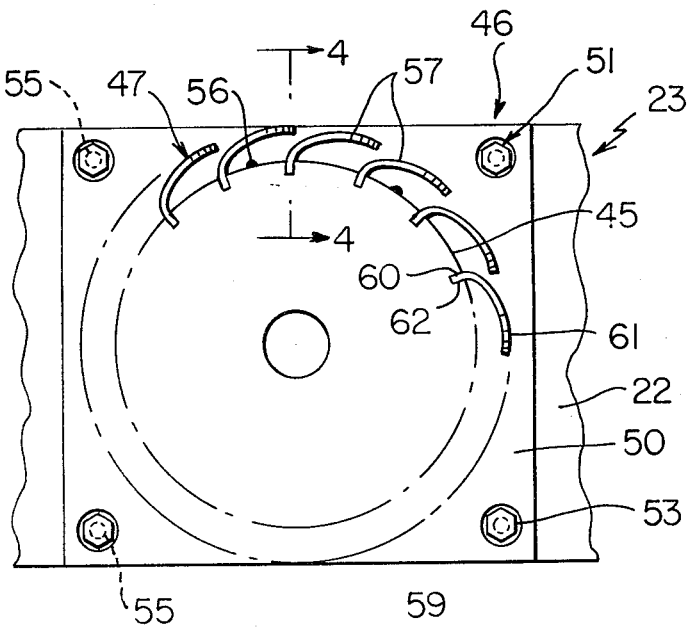
FIG. 3 is an enlarged view taken essentially on the line 3—3 of FIG. 2 and particularly illustrating cushioning means comprised of a plurality of resilient metal members defined as arcuate metal blades.

As indicated in the prior art statement of this specification, there are high or large horizontal loads exerted against the upstanding peripheral annular flange 35 comprising the truck bolster bowl 33 by the structure 23; and, such loads may be in the form of sustained loads which are produced when the railway cars are being either pushed or pulled or the loads may be in the form of comparatively high impact loads caused by the car striking or being struck by other vehicles during coupling, uncoupling, and the like. However, regardless of how loads against the flange 35 are produced, it is especially desirable to provide means for cushioning the horizontal loads and particularly the impact loads; and, the detailed description will now proceed with what will be referred to as the cushioned car body center plate structure 23 of this invention which provides for cushioning of such horizontal loads and for this description particular reference is now first made to FIGS. 3 and 4 of the drawings.

In particular the center plate structure 23 comprises a substantially right circular cylindrical disc-like component 45 which is adapted to be received within the confines of the upstanding peripheral flange 35 of an associated railway vehicle truck bolster bowl 33; and, in particular the disc-like component 45 is adapted to be received within the confines of the right circular cylindrical inside surface 36 of the flange 35. The center plate structure 23 also comprises means for mounting the component 45 to the body bolster 22 of the body 21 of the vehicle 20 and such mounting means is designated generally by the reference numeral 46. The mounting means 46 will be described in more detail subsequently. The center plate structure 23 further comprises means for cushioning the loads between the component 45 and the flange 35 and such cushioning means is designated generally by the reference numeral 47.

In accordance with the teachings of this invention the mounting means 46 comprises a plate 50, means 51 for detachably fastening the plate 50 to the body bolster 22, and means for supporting the component 45 on the plate 50.

The means 51 for detachably fastening in this example comprises a plurality of nut and bolt assemblies each designated by the same reference numeral 52. Each nut and bolt assembly 52 comprises a threaded bolt 53 having a head at one end and threads at its opposite end and such threads are adapted to have a cooperating threaded nut 54 threaded thereon upon passing the bolt 53 through a cooperating pair of aligned openings each designated by the same reference numeral. As seen in the drawings the aligned openings 55 are provided through the plate 50 (in the corners thereof) and the body bolster 22 and such openings 55 comprise the means 51.

The mounting means 46 also comprises means for supporting the component 45 on the plate 50 and in this example of the invention such supporting means comprises a plurality of spot welds each designated by the same reference numeral 56. The welds 56 serve to fix the disc-like component 45 to the plate 50.

The center plate structure 23 has cushioning means 47 as previously mentioned. The cushioning means 47 in the example of FIGS. 2–4 comprises a plurality of resilient metal members fixed to the component 45 and each of such metal members is designated by the reference numeral 57 with only a few representative ones of such metal members being so designated.

The metal members 57 are defined as arcuate metal blades 57 and each blade 57 has an inner end portion 60 fixed to the component 45 and a free outer end portion 61 which is adapted to yieldingly engage the flange 35 and in particular engage the inside surface 36 of such flange. Each arcuate blade 57 may have its inner end 60 fixed in position utilizing any technique known in the art; however, in this example of the invention each inner end 60 is press fitted within an associated slot 62 provided in the component 45. The press-fitting action is achieved by moving each arcuate blade 57, essentially as illustrated in FIG. 4, from the dotted line position shown at 63 to the solid line position illustrated.

Each arcuate metal blade 57 is supported in position such that upon moving the body center plate structure 23 and hence the component 45 relative to its associated annular flange 35 the outer ends 61 of the resilient arcuate blades tend to be flexed. The flexing action provides a cushioning between the body center plate structure 23 and the truck bolster bowl 33.

Figure 4:
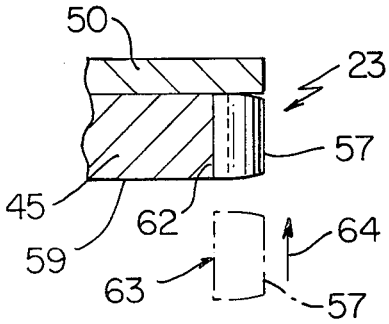
FIG. 4 is a fragmentary primarily cross-sectional view particularly illustrating the manner in which a typical arcuate blade of FIG. 3 is moved from a dotted line position thereof and fixed in position within an associated slot in an associated disc-like component.

In the illustration of FIG. 4, each arcuate metal blade 57 is shown as having the inner end portion thereof press fitted in an associated slot 62 in the component 45; and each blade is pressed from the outermost or bottom surface 59 of the component 45 inwardly as shown by the arrow 64.

Figure 5:
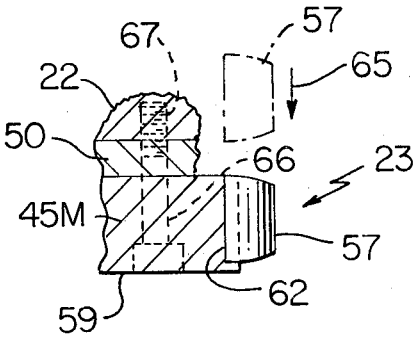
FIG. 5 is a view similar to FIG. 4 illustrating the manner in which an arcuate blade similar to the blade of FIG. 3 is fixed in position in a modified disc-like component.

A modification of the center plate structure 23 is shown in FIG. 5 and uses a modified component 45M which has slots 62 defined therein which extend axially from the inner part of the component 45M toward the bottom surface 59, without reaching same, so as to define an annular shoulder therearound. In this modification each blade 57 is pressed from the inside surface of the component 45 outwardly toward the surface 59 and as shown by the arrow 65 in FIG. 5. Also, in this modification the component 45M is held in position by a plurality of threaded bolts 66 which extend upwardly through associated openings in the component 45 and are threadedly received within associated blind threaded openings 67 in the body bolster 22.

Figure 6:
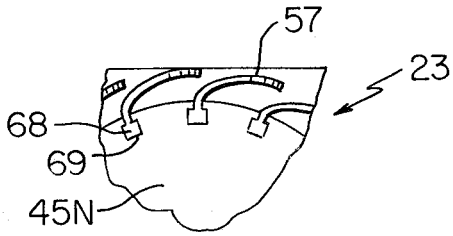
FIG. 6 is a fragmentary view illustrating a modification of an arcuate metal blade which may be used in lieu of the metal blades shown in FIGS. 3, 4, and 5.

Another modification of the center plate structure 23 is illustrated in FIG. 6 of the drawings. In the modification of FIG. 6 each arcuate blade 57 has an integral enlarged inner end portion 68 which is press fitted within a corresponding enlarged slot 69 in its component 45N to thereby provide an attachment of greater strength than the attachments provided in the illustrations of FIGS. 4 and 5.

The blades 57 have been described above as having their inner end portions press fitted in position within slots of their component (either 45, 45M or 45N); however, it is to be understood that such blades may be fixed in position using any suitable means, including welding or the like.

Other exemplary embodiments of railway vehicle body center plate structures of this invention are illustrated in FIGS. 7–8, 9–10, 11–14, 15, and 16–17. The center plate structures illustrated in FIGS. 7–8, 9–10, 11–14, 15, and 16–17 are similar to the center plate structure 23; therefore, such center plate structures will be designated by the reference numerals 23A, 23B, 23C, 23D, and 23E respectively and representative parts of each center plate structure which are similar to corresponding parts of the structure 23 will be designated in the drawings by the same reference numerals as in the center plate structure 23 (whether or not such representative parts are mentioned in the specification) followed by an associated letter designation, either A, B, C, D, or E and not described again in detail. Only those component parts of each center plate structure which are substantially different from corresponding parts of the center plate structure 23 will be designated by a new reference numeral also followed by the associated letter designation and described in detail.

Figure 7:
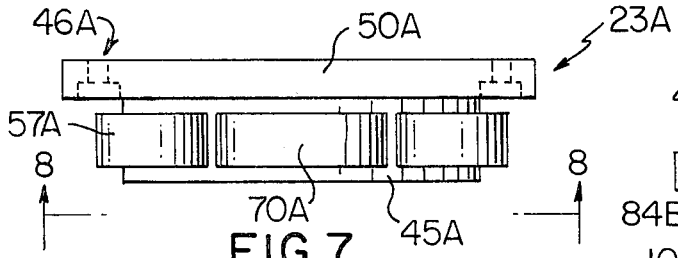
FIG. 7 is a side view of another exemplary embodiment of a cushioned center plate structure of this invention.
Figure 8:
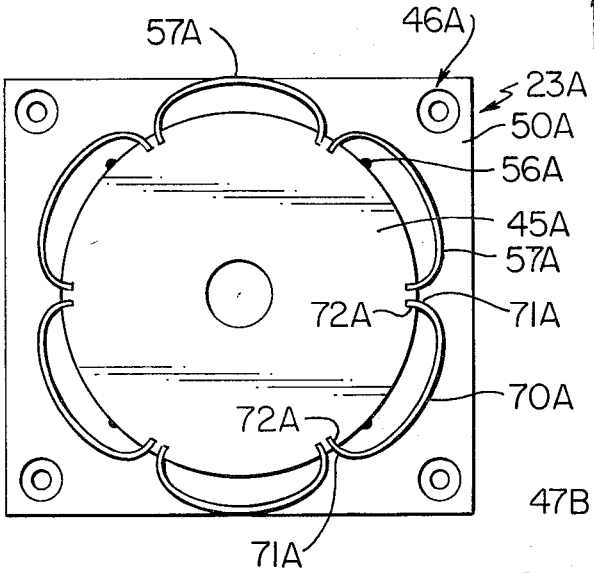
FIG. 8 is a view taken essentially on the line 8—8 of FIG. 7.

The center plate structure 23A of FIGS. 7–8 comprises mounting means 46A and such mounting means 46A comprises a plate 50A, means as previously described for detachably fastening the plate to the body bolster 22 (including openings in the plate 50A), and means for supporting the component 45A on the plate 50A in the form of a plurality of annular spot welds 56A. The center plate structure 23A has cushioning means 47A defined as a plurality of metal members 57A and such metal members are defined as roughly C-shaped blades 57A. Each C-shaped blade has a central portion 70A and opposite end portions 71A which are suitably fixed to the component 45A. In this example, the opposite end portions 71A are press fitted within associated slots 72A in the component 45A. The central portion 70A of each blade 57A is a yielding yet resilient bow-like structure which provides a cushioning action.

Figure 9:
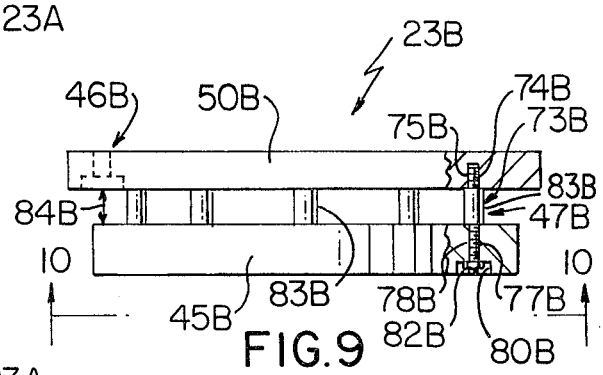
FIG. 9 is a view similar to FIG. 7, illustrating another exemplary embodiment of a cushioned center plate structure of this invention.
Figure 10:
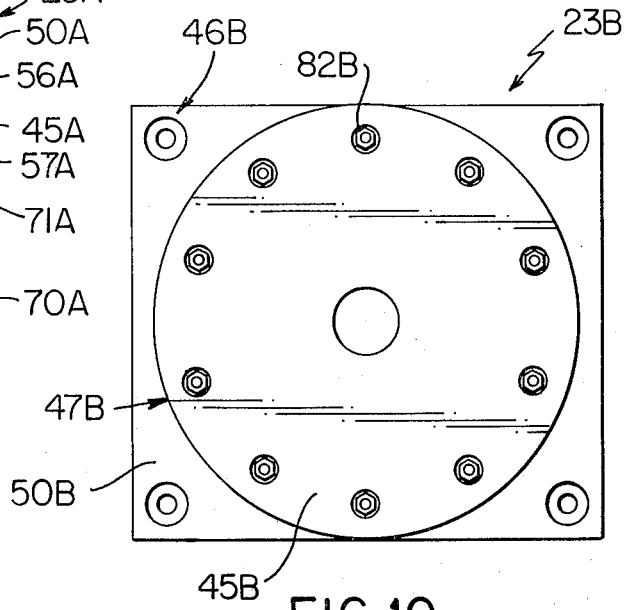
FIG. 10 is a view taken essentially on the line 10—10 of FIG. 9.
Figure 11:
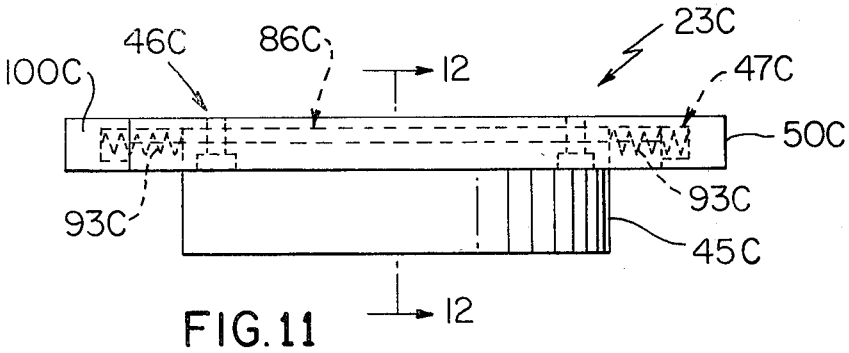
FIG. 11 is a view similar to FIG. 7, illustrating another exemplary embodiment of a cushioned center plate structure of this invention.
Figure 12:
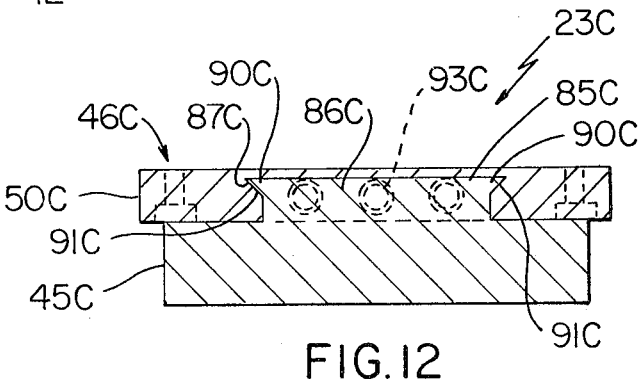
FIG. 12 is a cross-sectional view taken essentially on the line 12—12 of FIG. 11.

The center plate structure 23B of FIGS. 9 and 10 also comprises a cylindrical disc-like portions 45B, means 46B (including a plate 50B and openings in such plate) for mounting the component to the body bolster 22 of the railway vehicle 21, and cushioning means 47B. The cushioning means 47B is defined as a plurality of rectilinear rods 73B and each of the rods has opposite end portions or ends fastened to the plate 50B and the component 45B. The rods 73B serve the dual purpose of defining supporting means for supporting the component 45B on the plate 50B as well as defining the previously described cushioning means 47B.

Each rod 73B may be made of any suitable material known in the art and is such that it provides lateral deflection and a cushioning action. To facilitate the installation thereof on an associated structure each rod 73B has a threaded end portion 74B which is particularly adapted to be received within an associated threaded opening 75B in the plate 50B. Each rod 73B also has a threaded end portion 77B at the end thereof opposite from end portion 74B and the threaded portion 77B is particularly adapted to be extended through a plain smooth bore opening 78B in the component 45B. The opening 78B has a counterbored outer end portion 80B.

Each rod 73B is installed in position by threading its inner end portion 74B within an associated threaded opening 75B. The member 45B is then placed in position by extending threaded portions 77B through openings 78B. Threaded nuts 82B are then threaded around the threaded portions 77B thereby supporting the member 45B in position.

As seen in FIG. 9, each rod 73B has an enlarged central portion 83B defining annular shoulders at opposite ends thereof; and, the enlarged central portion with its annular shoulders, in essence, defines a precise spacing 84B between the inside surface or downwardly facing surface of the plate 50B and the inside or top surface of the component 45B. In addition, each central portion 83B is a yieldable yet resilient structure whereby the central portions 83B of all rods 73B cooperate to define the cushioning means 47B.

The center plate structure 23C of FIGS. 11–14 also comprises a disc-like component 45C, means 46C for mounting the component to the body bolster 22, and cushioning means 47C. The mounting means 46C of the structure 23C also has a plate 50C and means 51C for detachably fastening the plate to the body bolster 22, including openings in the corners of plate 50C.

The structure 23C comprises supporting means for supporting the component 45C on the plate 50C in the form of slide means 85C. The slide means 85C comprises a slide portion 86C which comprises the component 45C and a cooperating way 87C which comprises the plate 50C. In this example of the invention the slide portion 86C is defined as an integral part of the component 45C as a single-piece structure and portion 86C has a pair of projections 90C of roughly triangular or V-shaped cross-sectional configuration extending from opposite sides thereof. The projections 90C are adapted to be received within cooperating V-shaped grooves 91C comprising the way 87C provided in the plate 50C.

Figure 13:
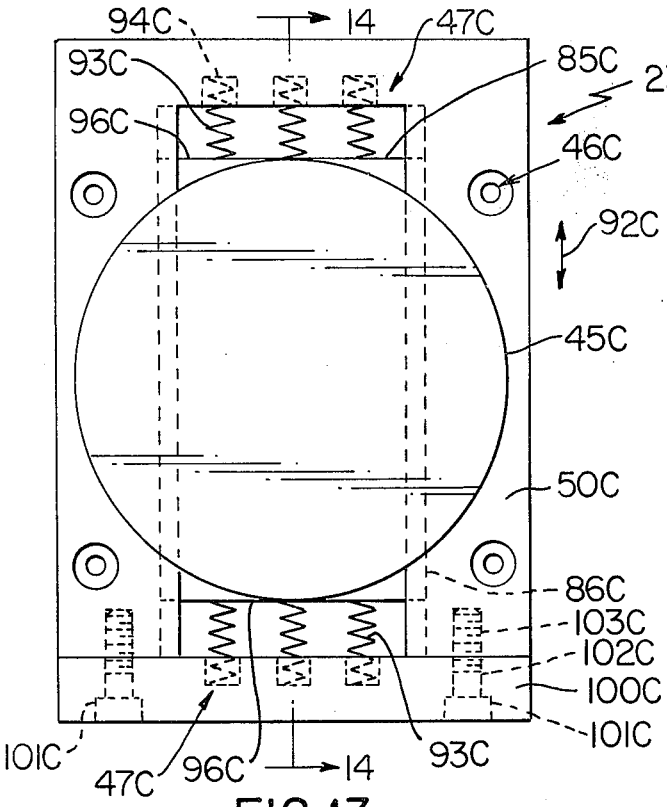
FIG. 13 is a view looking perpendicularly upwardly toward the bottom surface of the structure of FIG. 12.

The cushioned center plate structure 23C has cushioning means 47C defined as spring means acting between the slide portion 86C and the plate 50C to cushion the component 45C in opposed directions along a rectilinear path which is illustrated in FIG. 13 of the drawings by a double arrow 92C. The cushioning means of the structure 23C comprises at least one coil spring and in this example of the invention such cushioning means comprises a plurality of compressed coil springs, each designated by the same reference numeral 93C, engaging opposite ends of the slide portion 86C. Each spring 93C is a compression spring which has one end portion received within an associated blind cylindrical bore 94C (FIG. 14) in the plate 50C and has an opposite end engaging an associated surface 96C of the slide portion 86C. The structure 23C is such that it provides a cushioning action in opposed directions along the rectilinear path 92C and it will be appreciated that the structure 23C is installed on the railway vehicle body 21 such that the cushioning action is provided along the longitudinal axis of the railway vehicle 20. The cushioning springs 93C may be installed in position utilizing any technique known in the art. However, preferably such springs are installed in position and held under compression as will now be described.

The springs 93C may be installed in the structure 23C in a compressed condition utilizing any technique known in the art; however, preferably such springs are installed using an end cap 100C which comprises the structure 23C. In particular, the three springs 93C opposite from the end cap 100C are disposed with end portions thereof in their associated bores 94C. The slide portion 86C is then aligned axially with the way 87C and moved therealong with its projections 90C received within grooves 91C until the end 96C thereof is in engagement with the outer ends of the springs 93C. The three springs 93C are compressed by the slide portion 86C to their fully compressed axial height and held compressed by portion 86C whereupon the springs 93C for the opposite end of the structure 23C are disposed in associated bores 94C in the end cap 100C. The end cap 100C is then placed in position at the opposite end of the slide portion 86C and fastened by a plurality of threaded fastening bolts 101C. Each bolt 101C extends through an associated opening 102C in the cap 100C and is threadedly received within an associated opening 103C in the plate 50C. Once the threaded bolts 101C are threaded in position, the slide portion 86C is allowed to move and the overcompressed springs 93C at the end of the structure opposite from cap 100C are allowed to urge the entire slide portion 86C against the springs 93C associated with the end cap 100C partially compressing same. The net result is that the slide portion 86C and its component 45C are centered along path 92C as illustrated in FIG. 13 of the drawings; and, the springs 93C are in position to receive loads from either end thereof and provide a cushioning action in opposed directions along the rectilinear path 92C.

Figure 15:
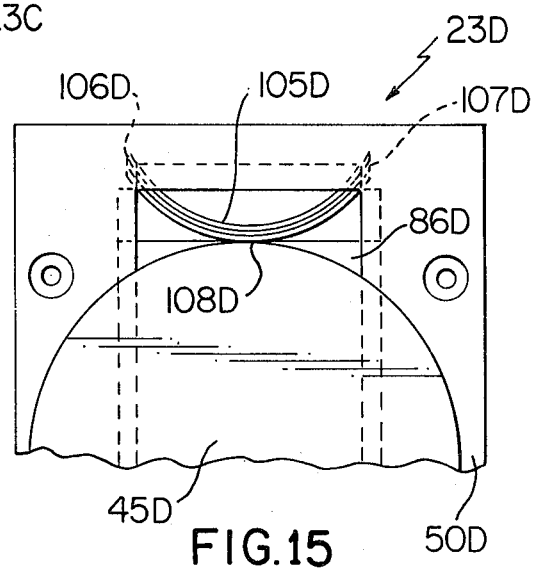
FIG. 15 is a fragmentary view similar to the top portion of FIG. 13 illustrating another exemplary embodiment of a cushioned center plate structure of this invention.
Figure 14:
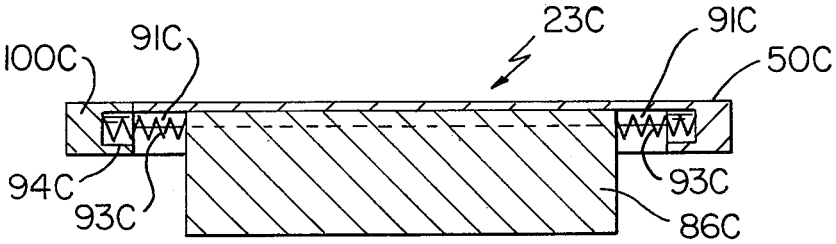
FIG. 14 is a cross-sectional view taken essentially on the line 14—14 of FIG. 13.

The center plate structure 23D of FIG. 15 is substantially identical to the structure 23C previously described except that instead of utilizing compression springs the structure 23D utilizes a plurality of arcuate leaf springs each designated by the same reference numeral 105D at each end of the slide portion 86D of the component 45D. The leaf springs 105D have opposite ends 106D which are received within associated slots 107D provided in the plate 50D and thereby held in position in a secure manner. The springs 105C at each end of structure 23D have yieldable yet resilient central portions 108D which are adapted to be bowed toward their open ends under load to provide a cushioning action.

Figure 16:
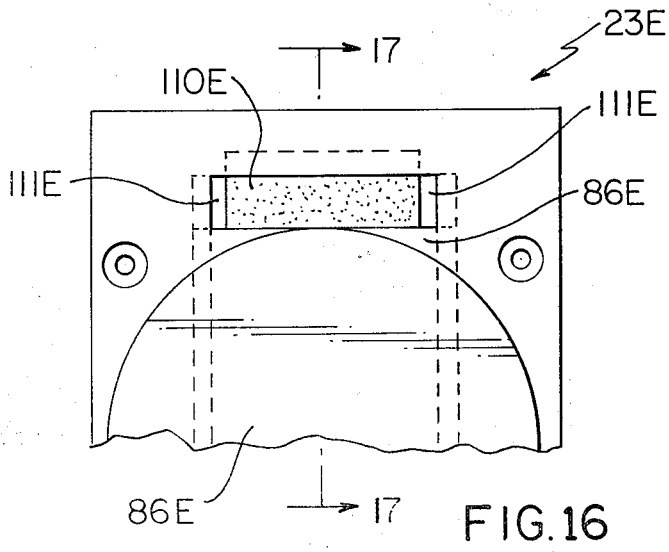
FIG. 16 is a view similar to FIG. 15 illustrating another exemplary embodiment of a cushioned center plate structure of this invention.
Figure 17:
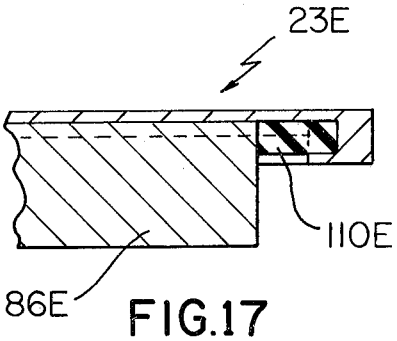
FIG. 17 is a fragmentary cross-sectional view taken essentially on the line 17—17 of FIG. 16.

The center plate structure 23E of FIGS. 16 and 17 is also substantially identical to the structure 23C previously described except that instead of utilizing compression springs the structure 23E utilizes spring means consisting of polymeric cushions 110E engaging opposite ends of the slide portion 86E. Such polymeric cushion 110E is provided with spaces 111E at opposite sides thereof for receiving displaced portions of such cushion once it is placed under compression due to a load being applied thereagainst. The polymeric material used to define each cushion 110E may be any suitable material which is yieldable yet resilient and may be a suitable rubber compound or a synthetic plastic material.

As described earlier the cushioning means disclosed in FIGS. 3–8 are defined by flexible members 57 or 57A. These flexible members 57 and 57A of cushioning means 47 and 47A respectively serve to distribute loads or forces over a substantially large area whereby likelihood of damage to the various adjacent components is minimized.

While present exemplary embodiments of this invention, and methods of practicing the same, have been illustrated and described, it will be recognized that this invention may be otherwise variously embodied and practiced within the scope of the following claims.

What is claimed is:

1. In a cushioned center plate structure for a railway vehicle body comprising, a substantially cylindrical disc-like component which is adapted to be received within the confines of an upstanding peripheral flange of an associated railway vehicle truck bolster bowl, means for mounting said component to a body bolster of said vehicle body, and means for cushioning loads between said component and flange, the improvement in which said mounting means comprises a plate, means for detachably fastening said plate to said body bolster, and means for supporting said component on said plate, said cushioning means comprising a plurality of resilient metal members defined as arcuate metal blades, each of said arcuate metal blades having an inner end portion fixed to said component and having a free outer end portion which is adapted to yieldingly engage said flange, said arcuate metal blades being adapted to be disposed within the confines of said flange.

2. In a cushioned center plate structure for a railway vehicle body comprising, a substantially cylindrical disc-like component which is adapted to be received within the confines of an upstanding peripheral flange of an associated railway vehicle truck bolster bowl, means for mounting said component to a body bolster of said vehicle body, and means for cushioning loads between said component and flange, the improvement in which said mounting means comprises a plate, means for detachably fastening said plate to said body bolster, and means for supporting said component on said plate, said cushioning means comprising a plurality of resilient metal members defined as roughly C-shaped blades, each of said C-shaped blades having opposite end portions fixed to said component and having a central portion thereof which is adapted to yieldingly engage said flange.

3. In a cushioned center plate structure for a railway vehicle body comprising, a substantially cylindrical disc-like component which is adapted to be received within the confines of an upstanding peripheral flange of an associated railway vehicle truck bolster bowl, means for mounting said components to a body bolster of said vehicle body, and means for cushioning loads between said component and flange, the improvement in which said mounting means comprises a plate, means for detachably fastening said plate to said body bolster, and means for supporting said component on said plate, said supporting means comprising slide means for supporting said component for reciprocating movements along a rectilinear path.

4. A structure as set forth in claim 3 in which said slide means comprises a slide portion comprising said component and a cooperating way comprising said plate.

5. A structure as set forth in claim 4 in which said cushioning means comprises spring means acting between said slide portion and said plate to cushion said component in opposed direction along said rectilinear path.

6. A structure as set forth in claim 5 in which said spring means comprises at least one coil spring engaging each end of said slide portion and an associated part of said plate.

7. A structure as set forth in claim 5 in which said spring means comprises at least one leaf spring engaging each end of said slide portion and an associated part of said plate.

8. A structure as set forth in claim 5 in which said spring means comprises at least one polymeric cushion engaging each end of said slide portion and an associated part of said plate.

9. In a method of making a cushioned center plate structure for a railway vehicle body comprising the steps of, constructing a substantially cylindrical disc-like component which is adapted to be received within the confines of an upstanding peripheral flange of an associated railway vehicle truck bolster bowl; providing a support plate, detachably fastening said plate to said body bolster, supporting said component on said plate, mounting said component to a body bolster of said vehicle body, providing a plurality of resilient metal members defined as arcuate metal blades, and fixing an inner end portion of each of said arcuate blades to said component so that an outer end portion thereof is free and is adapted to yieldingly engage said flange; and disposing said arcuate metal blades within the confines of said flange.

10. In a method of making a cushioned center plate structure for a railway vehicle body comprising the steps of, constructing a substantially cylindrical disc-like component which is adapted to be received within the confines of an upstanding peripheral flange of an associated railway vehicle truck bolster bowl; providing a support plate, detachably fastening said plate to said body bolster, supporting said component on said plate, and mounting said component to a body bolster of said vehicle body; providing a plurality of resilient metal members and fixing said metal members to said component to provide cushioning means for cushioning loads between said component and flange; and disposing said metal members within the confines of said flange, said step of providing said metal members comprising providing said metal members defined as roughly C-shaped blades and said fixing step comprising fixing opposite end portions of each of said C-shaped blades to said component so that a central portion thereof is adapted to yieldingly engage said flange.

* * * * *